US006283814B1

(12) United States Patent
Lee

(10) Patent No.: US 6,283,814 B1
(45) Date of Patent: Sep. 4, 2001

(54) FLAT CATHODE RAY TUBE AND METHOD OF MANUFACTURING SAME

(75) Inventor: Sang-hoon Lee, Daejeon-si (KR)

(73) Assignee: Samsung Display Devices Co., LTD, Suwon-si (KR)

( * ) Notice: Subject to any disclaimer, the term of this patent is extended or adjusted under 35 U.S.C. 154(b) by 0 days.

(21) Appl. No.: 09/162,338

(22) Filed: Sep. 28, 1998

(30) Foreign Application Priority Data

Sep. 26, 1997 (KR) ..... 97-48898
Sep. 26, 1997 (KR) ..... 97-48899

(51) Int. Cl.[7] ..... H01J 9/236
(52) U.S. Cl. ..... 445/30
(58) Field of Search ..... 445/30; 313/402, 313/407, 408

(56) References Cited

U.S. PATENT DOCUMENTS 4,593,225 * 6/1986 Dietch et al. ..... 313/407
4,925,421 * 5/1990 Van Den Broek ..... 445/30
4,964,828 * 10/1990 Patt et al. ..... 445/30
5,343,803 * 9/1994 Duchek et al. ..... 101/35

* cited by examiner

*Primary Examiner*—Nimeshkumar D. Patel
*Assistant Examiner*—Todd Reed Hopper
(74) *Attorney, Agent, or Firm*—Christie, Parker & Hale, LLP

(57) ABSTRACT

A flat cathode ray tube includes a front panel having an inner phosphor screen with a plurality of phosphor pixels and an inner edge side, a solid glass frame having a front side and a rear side, and a tensioned mask having a plurality of beam-guide holes corresponding to the phosphor pixels on the phosphor screen and an edge portion. The front panel is formed with a substantially flat shape. The front side of the solid glass frame is sealed to the edge side of the front panel. The edge portion of the tensioned mask is immersed in the solid glass frame. A funnel mounting a deflection yoke therearound and having a neck mounting an electron gun therewithin is sealed to the rear side of the glass frame. The phosphor screen of the front panel is formed by using a printing method.

8 Claims, 9 Drawing Sheets

FLAT CATHODE RAY TUBE AND METHOD OF MANUFACTURING SAME

CROSS REFERENCE TO RELATED APPLICATION

This application claims priority to Korean patent application Nos. 97-48898 and 97-48899 filed Sep. 26, 1997, the contents of which are incorporated hereinto by reference.

FIELD OF THE INVENTION

The present invention relates to a flat cathode ray tube (CRT) and a method of manufacturing the flat CRT and, more particularly, to a flat CRT manufacturing method capable of forming a phosphor screen in a simplified manner while eliminating waste of the screen formation materials and mounting a tensioned mask within the CRT without a separate fixing device.

BACKGROUND OF THE INVENTION

Generally, CRTs are designed to reproduce the original picture image on a screen through receiving the picture image signals and exciting phosphors coated on the screen with electron beams in accordance with the signals. The CRT usually includes a panel having an inner phosphor screen, a funnel sealed to the rear of the panel with a neck for accommodating an electron gun therein, and a color selecting shadow mask placed directly behind the phosphor screen of the panel.

The panel is usually formed with a curved shape. However, this panel shape causes distortion of the picture image reproduced on the periphery of the screen, reflects light, and limits the viewing angle. Thus, a flat CRT having a flat panel screen has been intensively investigated. In the flat CRT, the shadow mask is also formed with a flat shape and a tensioned mask is mainly employed for that purpose.

Internal stress in the tensioned mask due to tensile force in all directions compensates for thermal expansion of the mask due to collision of the electrons to thereby prevent a doming phenomenon.

However, since there are strong tensile forces in the tensioned mask, a mask frame for supporting the tensioned mask should be rigid enough to prevent it from being deformed. For this purpose, the mask frame is usually very large and heavy.

With such a mask frame, it is not easy for the mask assembly to be attached to or detached from the panel for the light-exposing purpose during the phosphor screen formation process. For this reason, a master mask should be additionally employed only for the light-exposing step. However, in such a case, it is difficult to align the phosphor pixel pattern formed by the master mask with the beam-guide hole pattern of the CRT mask.

Korean patent application No. 97-21629 filed May 29, 1997 by the present Inventor discloses a three-piece flat CRT with a mid glass interposed between the panel and the funnel. For the phosphor screen forming purpose, a slurry coating method is employed. The tensioned mask is fixed to the mid glass by using a metal fixture. This structure enables the mask assembly to be easily attached to or detached from the panel during the phosphor screen formation process. In addition, a frit or bead glass may be used to fix the tensioned mask to the mid glass.

However, for the tensioned mask fixing purpose, the metal fixture or the frit glass may be surplus or its use may involve loose-fitting between the tensioned mask and the mid glass.

Furthermore, the slurry coating method employed for the phosphor screen forming purpose involves waste of the screen formation materials and complicated processing steps.

SUMMARY OF THE INVENTION

It is an object of an embodiment of the present invention to provide a flat CRT and a method of manufacturing the flat CRT capable of forming a phosphor screen in a simplified manner while eliminating waste of phosphor materials and mounting a tensioned mask within the CRT without a separate fixing device.

In order to achieve this and other objects, an embodiment of the present invention provides a flat CRT including a front panel having an inner phosphor screen with a plurality of phosphor pixels and an inner edge side, a solid glass frame having a front side and a rear side, and a tensioned mask having a plurality of beam-guide holes corresponding to the phosphor pixels on the phosphor screen and an edge portion. The front panel is formed with a substantially flat shape. The front side of the solid glass frame is sealed to the edge side of the front panel. The edge portion of the tensioned mask is immersed in the solid glass frame. A funnel mounting a deflection yoke therearound and having a neck mounting an electron gun therewithin is sealed to the rear side of the glass frame.

The flat CRT manufacturing method includes the steps of printing a phosphor screen on an interior surface of a front panel with a printer, fixing a tensioned mask having a plurality of beam-guide holes to a glass frame, sealing the glass frame to the front panel, and sealing a funnel to the glass frame.

BRIEF DESCRIPTION OF THE DRAWINGS

A more complete appreciation of the invention, and many of the attendant advantages thereof, will be readily apparent as the invention becomes better understood by reference to the following detailed description when considered in conjunction with the accompanying drawings, wherein.

DETAILED DESCRIPTION OF THE INVENTION

Reference will now be made in detail to the preferred embodiment of the present invention, examples of which are illustrated in the accompanying drawings.

Figure 1:
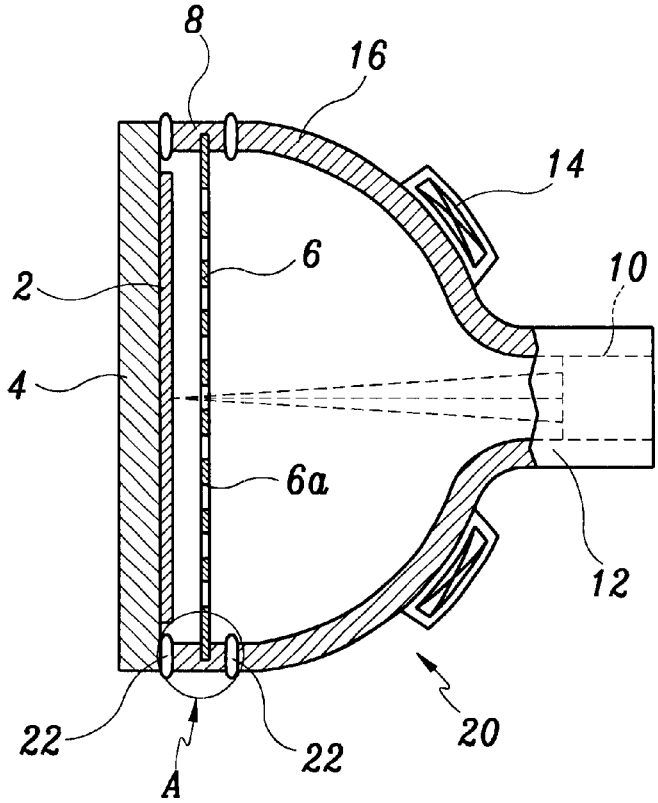
FIG. 1 is a schematic sectional view of a flat CRT according to an embodiment of the present invention.

FIG. 1 is a schematic sectional view of a flat panel CRT according to an embodiment of the present invention. As shown in FIG. 1, the flat CRT includes a front panel 4 having a substantially flat shape, a solid glass frame 8 sealed to the rear of the panel 4, and a funnel 16 sealed to the glass frame 8. A tensioned mask 6 is fixed to the glass frame 8 and placed directly behind the phosphor screen 2. A deflection yoke 14 is provided around the funnel 16. The funnel 16 has a neck 12 mounting an electron gun 10 therewithin. The panel 4, the funnel 16 and the neck 12 collectively form a bulb 20.

A phosphor screen 2 is formed on the interior surface of the panel 4 by using a printing method. Due to the flat shape of the panel 4, the printing operation can be easily performed.

For the color selecting purpose, a plurality of beam-guide holes are formed on the tensioned mask 6. The edge portion of the tensioned mask 6 is immersed in the solid glass frame 8 and, at this state, the glass frame 8 is sealed to the edge side of the front panel 4.

The deflection yoke 14 placed around the funnel 16 deflects, in every direction, electron beams emitted from the electron gun 10 in such a way that the electron beams can sequentially scan over all of the phosphors within the phosphor screen 2.

The edge portion of the tensioned mask 6 is preferably provided with a fixation member. Because of the contact, the fixation member makes with the glass frame 8, the tensioned mask 6 is rigidly fixed to the glass frame 8.

Figure 2:
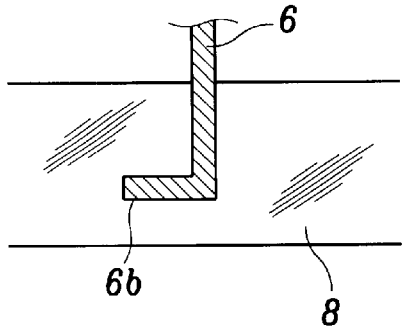
FIGS. 2 to 4 are enlarged sectional views of variations of the fixation member of the tensioned mask indicated in FIG. 1 as region A.
Figure 3:
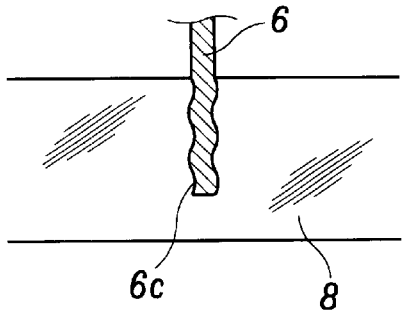
Figure 4:
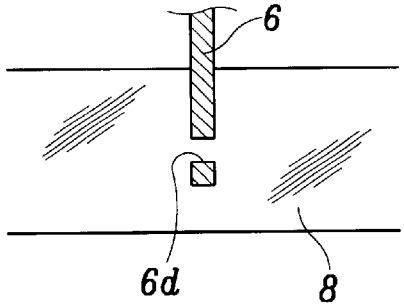

FIGS. 2 to 4 are enlarged sectional views of variations of the fixation member of the tensioned mask indicated in FIG. 1 as region A. As shown in FIG. 2, the edge portion of the tensioned mask 6 is formed with a bent portion 6*b*. Furthermore, as shown in FIG. 3, it may be formed with a prominent and depressed portion 6*c*.

Figure 5:
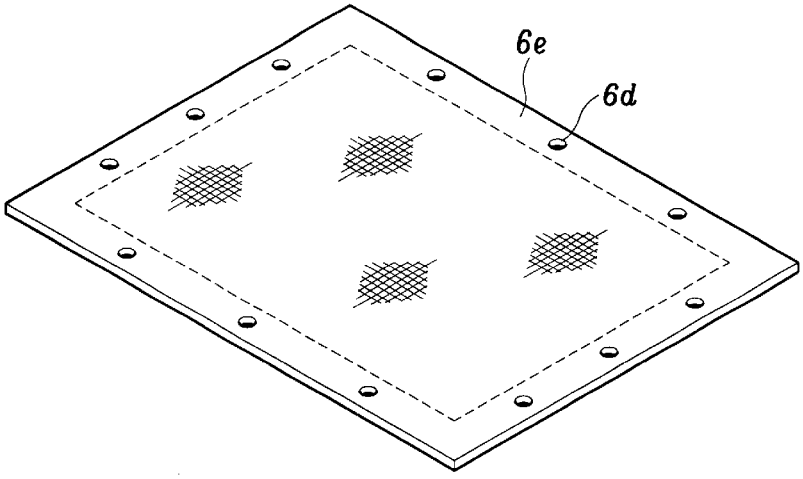
FIG. 5 is a perspective view of the tensioned mask having the fixation member shown in FIG. 4.

Alternatively, as shown in FIGS. 4 and 5, the edge portion of the tensioned mask 6 is formed with a bored portion 6*e* having a plurality of holes 6*d*. In this structure, when the glass frame 8 is formed, the glass solution for forming the glass frame 8 fills up the holes 6*d* so that the tensioned mask 6 can be rigidly secured to the glass frame 8.

With the flat-shaped front panel 4, a printing method is employed for processing the phosphor screen 2. This printing method insures the resulting flat CRT will have a simple and concise structure and involve simplified processing steps.

A method of manufacturing the flat CRT according to an embodiment of the present invention will be described with reference to the drawings.

Figure 6:
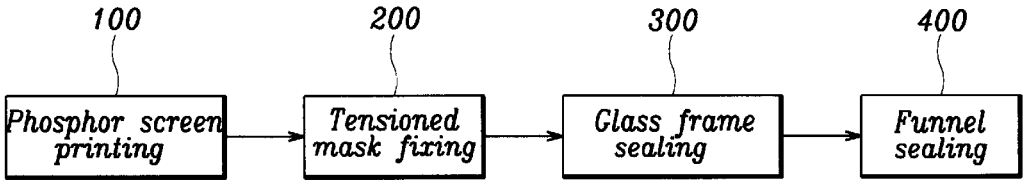
FIG. 6 is a flow chart illustrating a flat CRT manufacturing process according to an embodiment of the present invention.

FIG. 6 is a flow chart illustrating the flat CRT manufacturing method according to an embodiment of the present invention. As shown in FIG. 6, the method includes the steps of printing a phosphor screen on the interior surface of a front panel with a printer 100, fixing a tensioned mask having a plurality of beam-guide holes to a glass frame 200, sealing the glass frame to the front panel 300, and sealing the funnel to the glass frame 400.

Figure 7:
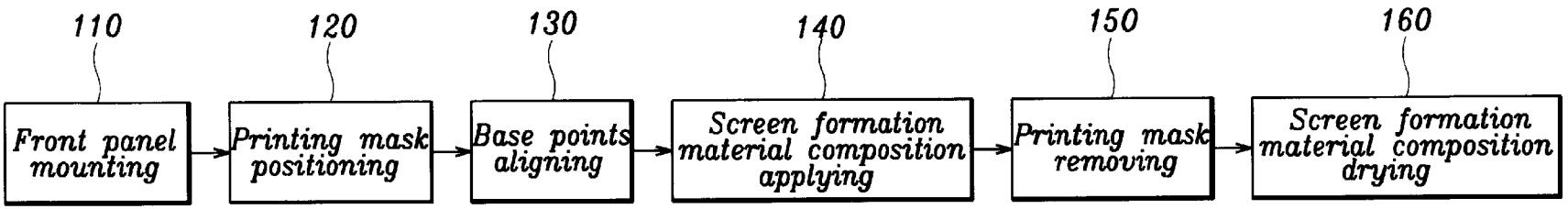
FIG. 7 is a flow chart illustrating a phosphor screen printing process.

The phosphor screen printing step 100 is performed by mounting the front panel in the printer and sequentially applying the appropriate screen formation materials on the interior surface of the front panel. Specifically, as shown in FIG. 7, the phosphor screen printing step 100 includes the steps of mounting the front panel in the printer 110, positioning a printing mask having a plurality of holes adjacent to the interior surface of the front panel 120, aligning a base point of the front panel with a base point of the printing mask 130, applying a screen formation material composition onto the front panel through the holes of the overlying printing mask 140, removing the printing mask away from the front panel 150, and drying the screen formation material composition applied onto the front panel 160.

The printing mask positioning step 120, the base points aligning step 130, the screen formation material composition applying step 140, the printing mask removing step 150 and the screen formation material composition drying step 160 are sequentially repeated by the number of times as many as the number of the screen formation material compositions to be applied. The screen formation material composition includes a black matrix composition, a green-emitting phosphor composition, a blue-emitting phosphor composition and a red-emitting phosphor composition.

Figure 8:
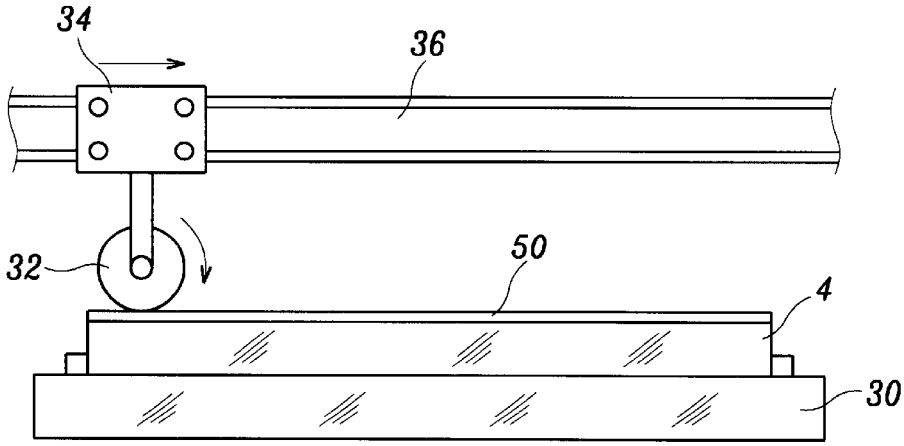
FIG. 8 is a schematic side view of a printer used in the phosphor screen printing process.

As shown in FIG. 8, the printer may include a supporting member 30 for supporting the front panel 4, a printing roller 32 for printing a phosphor screen on the interior surface of the front panel 4, a carrier 34 for delivering the printing roller 32, and a guide rail 36 for guiding the carrier 34.

The printing roller 32 has a cylindrical shape having a size similar to a longitudinal length of the printing mask 50. When the printing mask 50 is positioned on the interior surface of the panel 4, the printing roller 32 is arranged on the printing mask 50 and starts to apply the screen formation material composition from one end of the printing mask 50 to the opposite end. At this time, the movement of the printing roller 32 is performed by the carrier 34 which moves along the guide rail 36.

Figure 9:
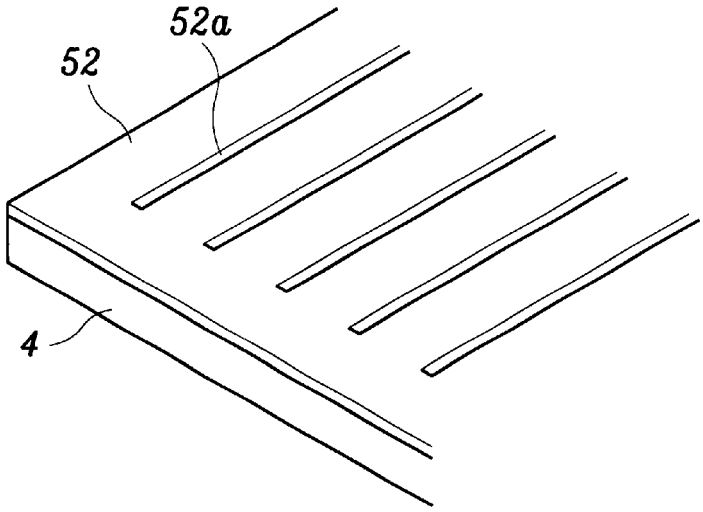
FIGS. 9 to 13 are schematic perspective views of a front panel and a printing mask illustrating the phosphor screen printing process.

In the black matrix formation process, as shown in FIG. 9, the front panel 4 is first mounted within the printer and a black matrix printing mask 52 is positioned on the interior surface of the panel 4. Thereafter, with an alignment sensor (not shown), the base point of the panel 4 is aligned with the base point of the black matrix printing mask 52.

The black matrix printing mask 52 is provided with a plurality of holes 52*a* having a shape identical to that of the black matrix to be printed on the interior surface of the panel 4. In this preferred embodiment, the hole 52*a* of the black matrix printing mask 52 has a grill-type shape.

Figure 10:
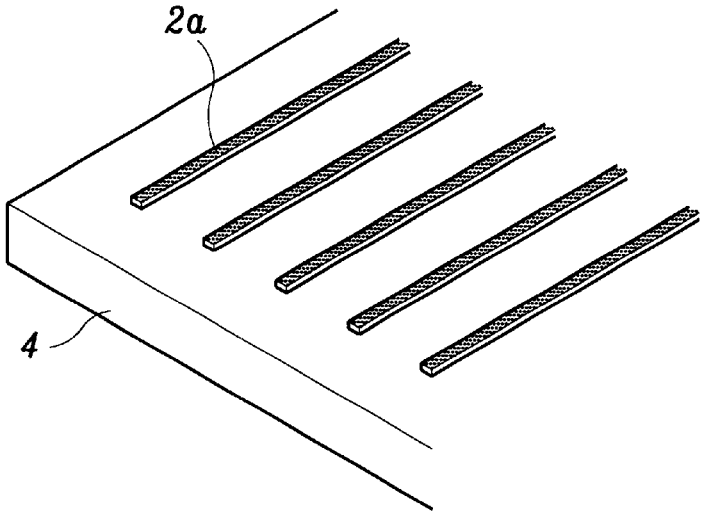

The printing roller 32, containing a black matrix composition, is then delivered onto the black matrix printing mask 52 and applies the black matrix composition onto the panel 4 through the holes of the overlying black matrix printing mask 52. Thereafter, the black matrix printing mask 52 is removed away from the panel 4. Consequently, as shown in FIG. 10, wet black matrix layers are left on the interior surface of the front panel 4 and dried to thereby form complete black matrix layers 2*a*.

Figure 11:
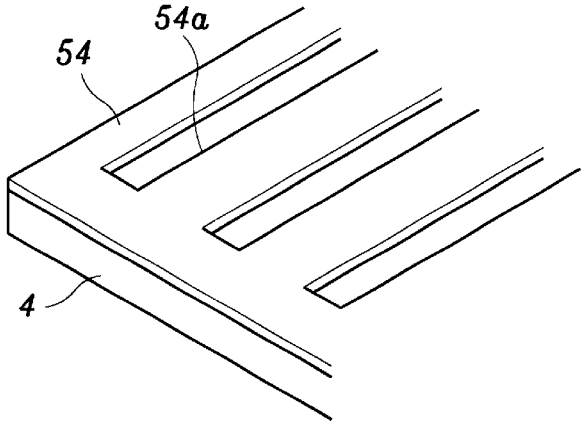
Figure 12:
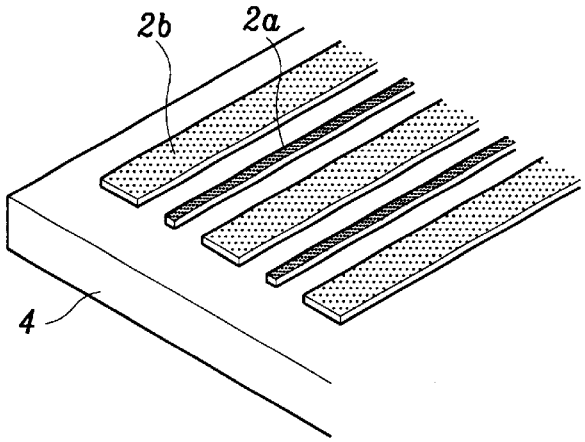

Then, three colors of phosphor layers are printed by repeating the above steps. As shown in FIG. 11, a green phosphor printing mask 54 having a plurality of holes 54*a* is arranged on the interior surface of the panel 4 with the previously formed black matrix layers 2*a*. The base point of the green phosphor printing mask 54 is aligned with the base point of the panel 4. Thereafter, a green-emitting phosphor composition is applied onto the appropriate portions of the interior surface of the panel 4 to thereby form green phosphor layers 2*b* shown in FIG. 12.

Figure 13:
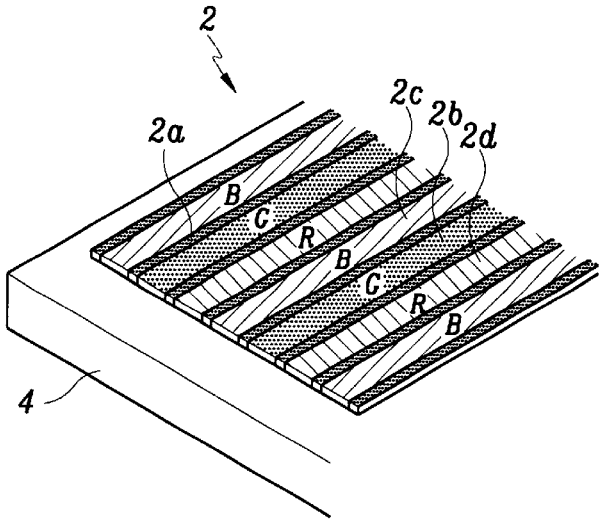

In the same way, blue phosphor layers 2*c* and red phosphor layers 2*d* are formed on the corresponding portions of the interior surface of the panel 4. Consequently, as shown in FIG. 13, a complete phosphor screen 2 can be formed.

With this printing method, the phosphor screen can be correctly formed in a simplified manner while eliminating waste of the screen formation materials.

The tensioned mask fixing process 200 will now be described with reference to FIGS. 14 to 16. The tensioned mask fixing process 200 is to fix the tensioned mask 6 to the glass frame 8. With the embodiment of the present invention, this fixing operation can be performed without a separate fixing device.

Figure 14:
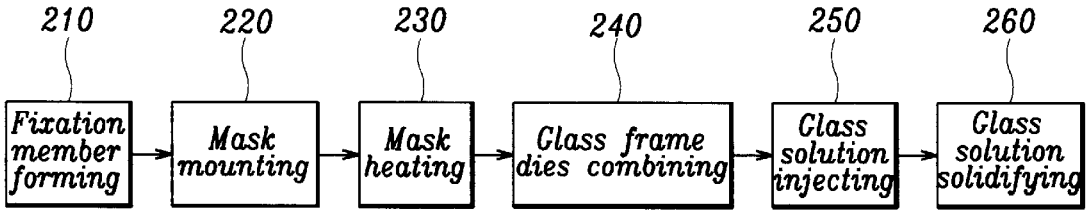
FIG. 14 is a flow chart illustrating the tensioned mask fixing process.

FIG. 14 is a flow chart illustrating the tensioned mask fixing process 200. The tensioned mask fixing process 200 includes the steps of providing the edge portion of the mask with a fixation member 210, mounting a mask onto a lower glass frame die in such a way as to allow for the edge portion of the mask to be placed on the lower glass frame die 220, heating the mask to thermally expand it 230, combining an upper glass frame die with the lower glass frame die to form a die assembly having an internal vacant space 240, injecting a glass solution into the vacant space of the die assembly 250, and slowly solidifying the glass solution injected into the vacant space of the die assembly to form a solid glass frame with the tensioned mask fixed thereto 260. Finally, the die assembly is removed away from the glass frame.

Figure 15:
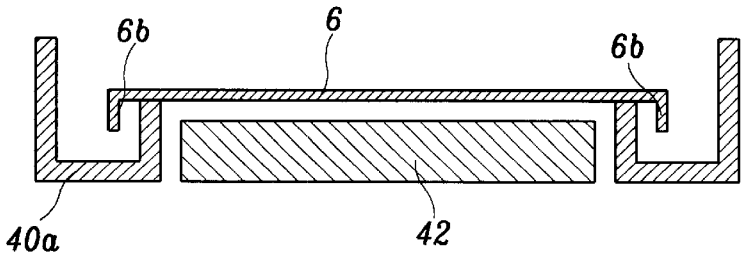
FIGS. 15 to 16 are schematic sectional views of a tensioned mask and a glass frame die illustrating the tensioned mask fixing process.
Figure 16:
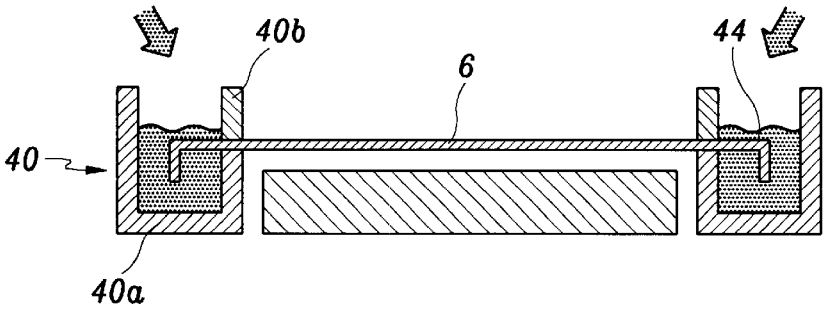
Figure 17:
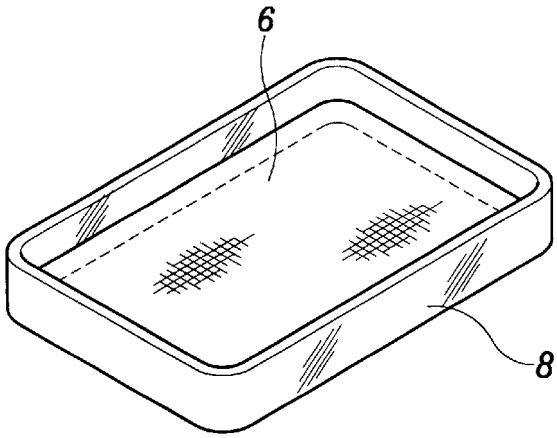
FIG. 17 is a perspective view of the tensioned mask fixed to a glass frame.

Specifically, as shown in FIGS. 15 to 16, the edge portion of the mask 6 is bent at a predetermined length. The bent portion 6*b* makes it possible to rigidly fix the mask 6 to the glass frame 8 by increasing contact area therebetween. As previously described with reference to FIGS. 3 and 4, instead of the bent portion 6*b*, the edge portion of the mask 6 may be formed with the prominent and depressed portion 6*c* or the bored portion 6*d*.

The mask 6 is then mounted onto the lower glass frame die 40*a* in such a way as to allow for the edge portion of the mask 6 to be placed on the lower glass frame die 40*a* and a heater 42 having a flat heating surface is arranged under the bottom of the mask 6. In this state, the mask 6 is heated to be thereby thermally expanded.

When the thermal expansion of the mask 6 reaches a predetermined degree, an upper glass frame die 40*b* is combined with the lower glass frame die 40*a* to form a die assembly 40 having an internal vacant space. Thereafter, a glass solution 44 is injected into the vacant space of the die assembly 40 and slowly solidified. At this time, the expanded mask is tightly secured into the solidified glass frame 8 while being provided with a strong tensile strength.

With this fixation structure, a separate fixing device is no longer required so that the CRT can be produced with a simple structure as well as the reduced weight.

After the tensioned mask is fixed to the glass frame 8, one side of the glass frame 8 is sealed to the edge portion of the panel 4 and, in turn, the funnel 16 is sealed to the opposite side of the glass frame 8.

This sealing operation is performed by providing a frit glass 22 between the panel 4 and the glass frame 8 as well as between the glass frame 8 and the funnel 16, heating and solidifying the frit glass 22.

As described above, with the embodiment of the present invention, the phosphor screen is formed by a printing method so that it can be correctly formed in a simplified manner while eliminating waste of the screen formation materials. Furthermore, since the tensioned mask is directly fixed to the glass frame without a separate fixing device, the structure of the flat CRT can be simplified with the reduced weight while enhancing the production efficiency.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A method of manufacturing a flat cathode ray tube having a front panel with a substantially flat shape, the method comprising the steps of:

printing a phosphor screen on an interior surface of the front panel with a printer;

fixing a tensioned mask having a plurality of beam-guide holes to a glass frame;

sealing the glass frame to the front panel; and sealing a funnel to the glass frame;

wherein the tensioned mask fixing step further comprises the steps of, mounting an edged portion of the mask onto a lower glass frame die;

heating the mask to thermally expand the mask and give a tensional force to the mask, combining an upper glass frame die with the lower glass frame die to form a die assembly having an internal vacant space, injecting a glass solution into the vacant space of the die assembly; and solidifying the glass solution injected into the vacant space of the die assembly to form a solid glass frame with the tensioned mask fixed thereto, and removing the die assembly from the glass frame.

2. The method of claim 1 wherein the tensioned mask fixing step further comprises the step of providing the edge portion of the mask with a fixation member, the fixation member providing step being performed before the mask mounting step.

3. The method of claim 2 wherein the fixation member providing step is performed by bending the edge portion of the mask at a predetermined length.

4. The method of claim 2 wherein the fixation member providing step is performed by treating the edge portion of the mask to form a prominent and depressed portion.

5. The method of claim 2 wherein the fixation member providing step is performed by boring the edge portion of the mask to form at least one hole with a predetermined size.

6. The method of claim 1 wherein the mask heating step is performed by positioning a heater with a flat heating surface under the mask and operating the heater.

7. The method of claim 1 wherein the glass frame sealing step is performed by providing a frit glass between the glass frame and the front panel, and heating and solidifying the frit glass.

8. The method of claim 1 wherein the funnel sealing step is performed by providing a frit glass between the glass frame and the front panel, and heating and solidifying the frit glass.

* * * * *